166-274 SR
4/12/88 XR 4,736,793

United States Patent [19]
Djabbarah

[11] Patent Number: 4,736,793
[45] **Date of Patent: * Apr. 12, 1988**

[54] TALL OIL AS ADDITIVE IN GAS DRIVE HYDROCARBON OIL RECOVERY

[75] Inventor: Nizar F. Djabbarah, Richardson, Tex.

[73] Assignee: Mobil Oil Corporation, New York, N.Y.

[ * ] Notice: The portion of the term of this patent subsequent to Aug. 12, 2003 has been disclaimed.

[21] Appl. No.: 815,105

[22] Filed: Dec. 31, 1985

Related U.S. Application Data

[63] Continuation-in-part of Ser. No. 593,465, Mar. 26, 1984, Pat. No. 4,605,066.

[51] Int. Cl.[4] ..... E21B 43/22
[52] U.S. Cl. ..... 166/273; 166/274
[58] Field of Search ..... 166/273–275; 252/8.55 D

[56] References Cited

U.S. PATENT DOCUMENTS

| | | | |
|---|---|---|---|
| 3,330,344 | 7/1967 | Reisberg | 166/275 |
| 3,497,007 | 2/1970 | Williams et al. | 166/273 |
| 3,616,853 | 11/1971 | Ayres, Jr. | 166/274 |
| 3,823,774 | 7/1974 | Chiu | 166/252 |
| 3,856,086 | 12/1974 | Braden, Jr. | 166/273 |
| 3,892,668 | 7/1975 | Chiu | 166/275 |
| 3,894,584 | 7/1975 | Fertl | 166/274 |
| 3,943,059 | 3/1976 | Chiu | 166/274 |
| 4,526,231 | 7/1985 | Radke | 166/274 |
| 4,561,501 | 12/1985 | Shaw et al. | 166/274 |
| 4,605,066 | 8/1986 | Djabbarah | 166/274 |

*Primary Examiner*—Stephen J. Novosad
*Assistant Examiner*—Bruce M. Kisliuk
*Attorney, Agent, or Firm*—Alexander J. McKillop; Michael G. Gilman; Stanislaus Aksman

[57] ABSTRACT

A gas-drive hydrocarbon oil recovery process comprises injecting into a subterranean, viscous oil-containing formation tall oil to reduce the minimum miscibility pressure (MMP) of the reservoir oil-displacing fluid system and increase the viscosity of the displacing fluid. The tall oil is injected as a separate slug either simultaneously with or before the injection of a slug of the displacing fluid. A drive fluid may also be injected into the formation after the injection of the displacing fluid and tall oil to aid in the recovery of the formation oil.

20 Claims, 3 Drawing Sheets

TALL OIL AS ADDITIVE IN GAS DRIVE HYDROCARBON OIL RECOVERY

CROSS-REFERENCE TO RELATED APPLICATIONS

This is a continuation-in-part of application Ser. No. 593,465, filed on Mar. 26, 1984, now U.S. Pat. No. 4,605,066 the entire contents of which are incorporated herein by reference.

FIELD OF THE INVENTION

This invention relates to an improved gas drive method for the recovery of oil from a subterranean, viscous oil-containing formation.

BACKGROUND OF THE INVENTION

When a well is completed in a subterranean reservoir, at least some of the oil present in the reservoir is removed from the reservoir through the well by primary recovery methods. These methods include utilizing native reservoir energy in the form of water or gas existing under sufficient pressure to drive the oil from the reservoir through the well to the earth's surface. This native reservoir energy most often is depleted long before all of the oil present in the reservoir has been removed from it. Additional oil can be removed by enhanced recovery methods comprising adding energy from outside sources to the reservoir either before or subsequent to the depletion of the native reservoir energy.

Such enhanced recovery methods include miscible phase displacement techniques wherein a fluid or fluids miscible with the reservoir oil are introduced into the reservoir through an injection well to displace the oil from the pores of the reservoir and drive it to a production well. The miscible fluid is introduced into the injection well at a sufficiently high pressure to drive the body of fluid through the reservoir where it collects and drives the reservoir oil to the production well.

The process of miscible flooding is extremely effective in stripping and displacing the reservoir oil from the reservoir through which the solvent flows. The high degree of effectiveness is derived from the fact that a two-phase system within the reservoir and between the solvent and the reservoir is eliminated at the conditions of temperature and pressure of the reservoir, thereby eliminating the retentive forces of capillarity and interfacial tension which are significant factors in reducing the recovery efficiency of oil in conventional flooding operations where the displacing agent and the reservoir oil exist as two phases in the reservoir.

More recently, various gases, such as nitrogen, carbon dioxide ($CO_2$) and methane, have been used successfully as displacing fluids in oil recovery processes. Carbon dioxide is a particularly desirable material because it is highly soluble in oil. The dissolution of carbon dioxide in oil decreases the oil viscosity and increases the volume of oil, both of which improve the recovery efficiency of the process. Carbon dioxide is sometimes employed under immiscible conditions. However, the most efficient displacement of reservoir oil by $CO_2$ occurs when the $CO_2$ is miscible in the oil. This miscibility takes place at a pressure greater than a certain minimum, see Stalkup, F.I., "Carbon Dioxide Miscible Flooding: Past, Present, and Outlook for the Future", *Journal of Petroleum Technology,* (August 1978) pp. 1102–1112. This minimum pressure is defined as the carbon dioxide minimum miscibility pressure (MMP). The magnitude of the MMP depends on the properties and composition of reservoir oil and the purity of the $CO_2$ and temperature. The effect of temperature is discussed in an article by Yellig et al, "Determination and Prediction of $CO_2$ Minimum Miscibility Pressures", *Journal of Petroleum Technology,* (1980), Vol. 32, pp. 160–168, where it is shown that for every 50° F. drop in temperature, the $CO_2$ MMP decreases by about 600–700 psia.

It is also known to use tall oil as an additive in aqueous surfactant systems, e.g., see Chin, U.S. Pat. Nos., 3,892,668 and 3,823,774, Reisberg, U.S. Pat. No. 3,330,344, Williams et al, U.S. Pat. No. 3,497,007 and Chiu, U.S. Pat. No. 3,943,059.

SUMMARY OF THE INVENTION

Oil is recovered from a subterranean, oil-containing formation penetrated by at least one injection well and at least one spaced-apart production well, being in fluid communication with each other, in a multi-step process.

In the first step, tall oil slug is injected into the formation through the injection well. The size of the slug is such that it establishes a miscible transition zone with the contiguous formation oil. Subsequently, a displacing fluid is injected into the formation to drive the miscible slug and reservoir oil toward the production well. Finally, the oil is recovered through the production well. The above process may be repeated as often as necessary.

Alternatively, the tall oil may be coinjected with the displacing fluid into the formation. Then injection of the tall oil is stopped while the injection of the displacing fluid is continued. The process may be repeated as often as necessary.

If reservoir temperature and pressure are such that the tall oil and the displacing fluid form a single phase, then a mixture of the tall oil and the displacing fluid is injected into the formation, followed by the injection of the displacing fluid. Again, the process is repeated as often as necessary.

If desired, a drive or driving fluid may be injected into the formation in any of the above embodiments, after the injection of the displacing fluid and tall oil is completed.

In any of the above processes, the injection of tall oil reduces the minimum miscibility pressure of the reservoir oil-displacing fluid system and increases the viscosity of the displacing fluid. The first effect permits efficient miscible displacements at pressures lower than the MMP with the displacing fluid alone. The second effect delays the early breakthrough of the displacing fluid and increases its sweep efficiency.

DETAILED DESCRIPTION OF THE INVENTION

Figure 1:
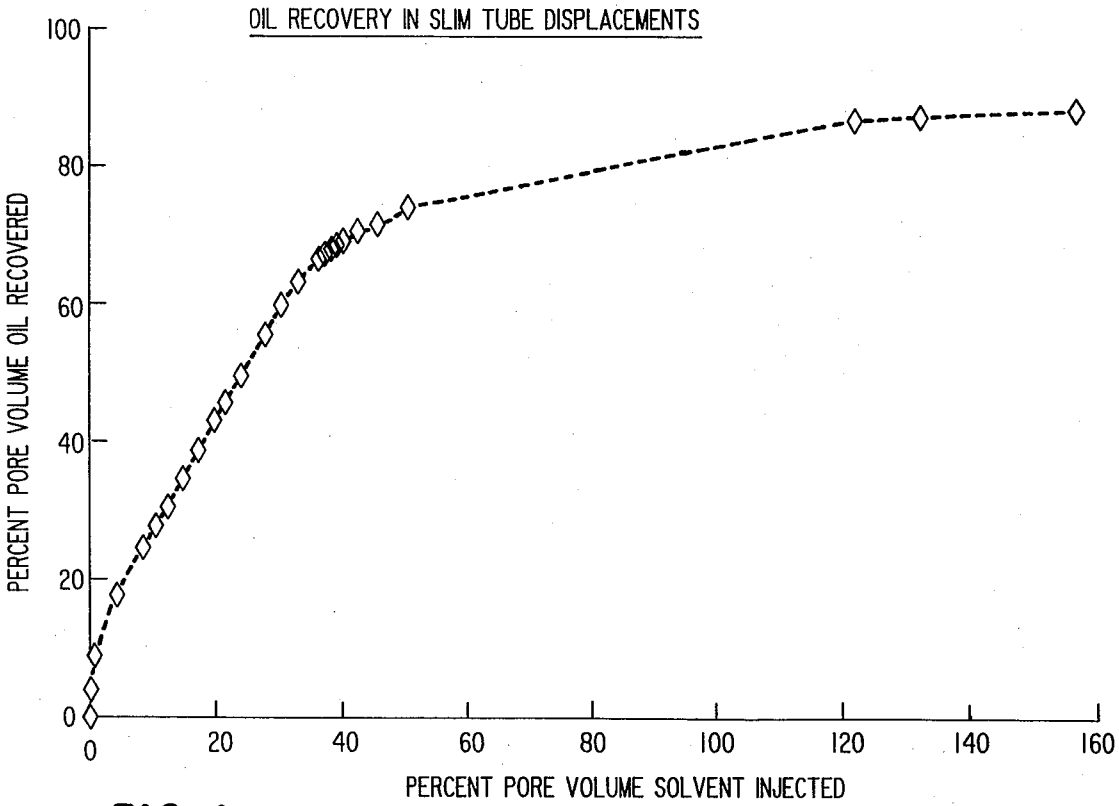
FIG. 1 is a graphical representation of the relationship of the amount of oil recovered, expressed as percent of pore volume of oil recovered, as a function of pore volume of $CO_2$ injected at 2320 psi (Example 1).

When tall oil is injected as a separate slug either before or between two slugs of the displacing fluid, the ratio of the size of the displacing fluid slug to that of the tall oil is governed by the phase behavior of the tall oil-reservoir oil-displacing fluid mixture at reservoir conditions of temperature and pressure. Ideally the conditions are such that the tall oil is mutually soluble in the reservoir oil and in the displacing fluid at the reservoir temperature and pressure. The ratio of the size of the displacing fluid slug to that of the tall oil is between about 2:1 and about 10:1 by volume, measured at reservoir temperature and pressure. For example, a ratio of 2:1 implies that the volume of the displacing fluid slug, as measured at reservoir temperature and pressure, is twice the volume of the tall oil slug. Preferably, the size of the displacing fluid slug to that of the tall oil is between about 4:1 and about 6:1. The amount of the tall oil slug injected into the formation must be such that the leading end of the slug generates a miscible transistion zone with reservoir oil and the trailing end generates a viscosity buffer that impedes viscous fingering and delays the early breakthrough of the displacing fluid.

When the tall oil is coinjected with the displacing fluid, the ratio of the displacing fluid slug to that of the tall oil is between about 1:20 and about 10:1, by volume, measured at reservoir temperature and pressure, depending on the duration of the coinjection process and on the formation of miscible transition zone and the desired increase in the viscosity of the displacing fluid.

If reservoir temperature and pressure are such that the tall oil and the displacing fluid form a single phase, then the concentration of the tall oil in the mixture is dictated by the phase behavior of the mixture, i.e., the tall oil concentration must be such as to form a single phase at the reservoir temperature and pressure. The concentration of the displacing fluid in the mixture in this embodiment is not greater than about ten (10) percent by weight, preferably, it is about one (1) percent by weight. The exact amount of the displacing fluid injected will vary, as will be apparent to those skilled in the art, depending upon reservoir conditions and the economics of the process. For purposes of illustration, when carbon dioxide is used as the displacing fluid, the amount thereof which is injected ranges from about 10% to about 40% of the hydrocarbon pore volume.

After the miscible transition zone is established between the formation oil and the displacing fluid, a driving fluid may be injected through the injection well to displace the oil, the transition zone and the displacing fluid through the formation towards the production well from which the oil is produced. The drive fluid is injected for a sufficient time to effect the displacement of the formation oil to the production well until either all of the oil has been displaced from the formation or until the econimical limit of the ratio of the driving fluid to the formation oil has been reached.

The tall oil used in the present invention is a major inexpensive by-product of the paper industry and it is obtained by reacting black liquor soap with sulfuric acid and water. A typical composition of crude tall oil is about 50% by weight long chain fatty acids, 40% rosins and 10% sterols (long chain cyclic alchols, such as cholesterol). Tall oil is highly soluble in crude oil and negligibly soluble in water. Examples of commercially-available tall oils which can be utilized in the process are ACINTOL D30LR and D40LR Distilled Tall Oils, ACINTOL FA1 Tall Oil Fatty Acid and ACINTOL P Tall Oil Pitch, all available from the Arizona Chemical Company, Fair Lawn, N.J.

The displacing fluid used in the invention can be any displacing fluid known in the art, but it is preferably a gas selected from the group consisting of carbon dioxide, carbon monoxide, methane, ethane, propane, butane, natural gas, liquid petroleum gas, nitrogen, ambient air, steam, flue gas, and mixtures thereof. Preferably, the displacing fluid is carbon dioxide.

Similarly, the drive fluid or driving fluid used in the process of the invention may be any drive fluid known to those skilled in the art, but preferably it is a fluid selected from the group consisting of water, brine, methane, carbon dioxide, nitrogen, air, steam, separator gas, natural gas, flue gas and mixtures thereof. The driving fluid may contain additives, such as a surfactant, to maintain efficient displacement thereof.

The process of the invention is preferably used in a subterranean, oil-containing formation penetrated by at least one injection well and at least one production well, spaced-apart from the injection well. The injection and production wells are in fluid communication with the formation and with each other through at least one perforation, either naturally occurring or man-made in the formation. The invention is particularly useful in the processes of recovering oil when the MMP of the displacing fluid-reservoir oil system is higher than current reservoir pressure, fracture pressure, or fracture propagation pressure. In addition, it is useful to counteract the effect of contaminants which are present in the displacing fluid stream either when it is supplied for injection or after the breakthrough of the displacing fluid when it is desired to reinject it in the formation. For example, Stalkup (F. I. Stalkup, "Miscible Displacement," SPE Monograph Volume 8, page 141, 1983) showed that 20 mole percent methane increases the MMP of a $CO_2$-reservoir oil system to 2000 psi from 1200 psi, with $CO_2$ along. The same concentration of nitrogen increases the MMP of the same system to 4200. The process of the invention may be practiced using a variety of well patterns as is well known to those skilled in the art, such as inverted five spot pattern in which an injection well is surrounded with four production wells, or a line drive arrangement in which a series of aligned injection wells and a series of aligned production wells are utilized. Any number of wells arranged according to any suitable pattern may be applied in utilizing the process of the present invention. A suitable pattern of wells may be selected by those skilled in the art from the disclosure of Burdyn et al, U.S. Pat. 3,927,716, the disclosure of which is incorporated herein by reference.

The minimum miscibility pressure for a given displacing fluid can be determined by experimental techniques known to those skilled in the art, such as the slim tube method for determining the MMP of the carbon dioxide as described in Yellig et al, "Determination and Prediction of $CO_2$ Minimum Miscibility Pressures", *Journal of Petroleum Technology,* Vol. 32, (1980), pp. 160–168, the entire disclosure of which is herein incorporated by reference.

Once the MMP of a given displacing fluid is determined, the amount of the desired reduction of the MMP for the displacing fluid and the specific formation is determined. Subsequently, the amount of the tall oil necessary to effect the necessary reduction in the MMP is determined by any suitable, known method, e.g., the slim tube method. That amount of the tall oil is then injected into the formation, as described above. Subsequently, a drive fluid is injected into the formation through the injection well to drive the oil towards the production well and finally the oil is recovered through the production well.

The following Examples further illustrate the essential features of the invention. However, it will be apparent to those skilled in the art that the specific reactants and reaction conditions used in the Examples do not limit the scope of the invention.

EXAMPLE 1

(Oil Displacement with $CO_2$)

Figure 2:
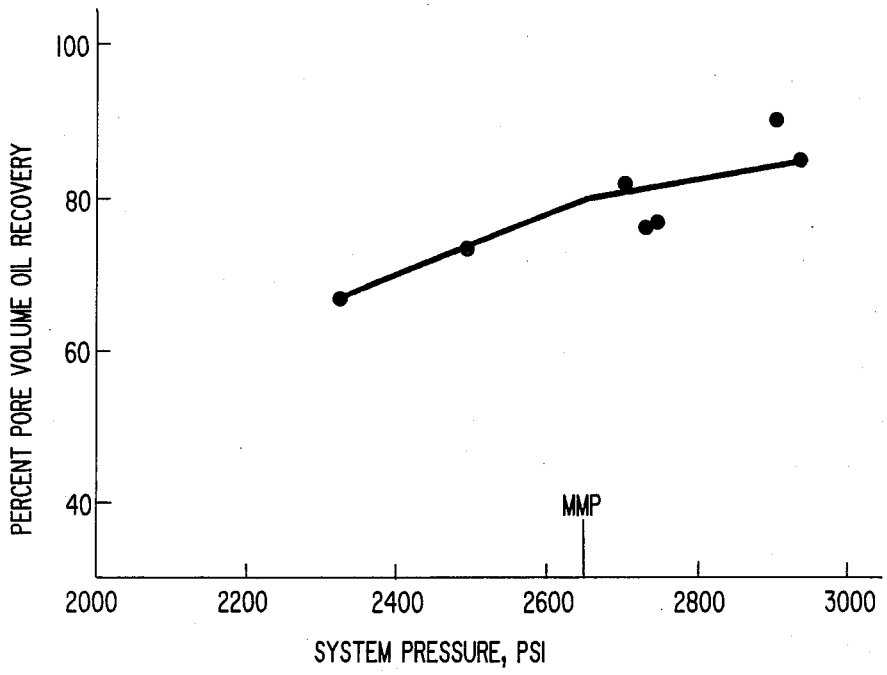
FIG. 2 shows percent of oil recovery as a function of system pressure for $CO_2$-reservoir oil system (Example 1).

A $\frac{1}{4}$ in. diameter×50 ft. long slim tube packed with 140–200 mesh Ottawa sand and saturated with 32 Deg. API gravity oil was used in this example. The oil was recombined with methane to a bubble point pressure of 2200 psi. In the first series of tests, the displacement experiments involved the injection of pure $CO_2$ into the slim tube at each of the following pressures: 2320, 2490, 2700, 2730, 2740 psi. Volumes of oil and gas recovered were measured as functions of the volume of $CO_2$ injected. Percent pore volume oil recovered was calculated as a function of the pore volume of $CO_2$ injected and a plot of percent pore volume oil recovery as a function of percent pore volume of $CO_2$ injected was prepared at each pressure. A typical plot is given in FIG. 1 for a the test which was conducted at 2320 psi. The percent oil recovery at $CO_2$ breakthrough was determined from each plot and a plot percent oil recovery as a function of system pressure was prepared and is shown in FIG. 2. This plot was used for the determination of the MMP of this $CO_2$-oil system, which was 2650 psi. Displacements below the above pressure were immiscible based on oil recovery and on observation of effluent fluid behavior. Displacements above 2650 psi were miscible based on the same criteria.

Example 2

(Oil Displacement with $CO_2$ and Tall Oil)

Figure 3:
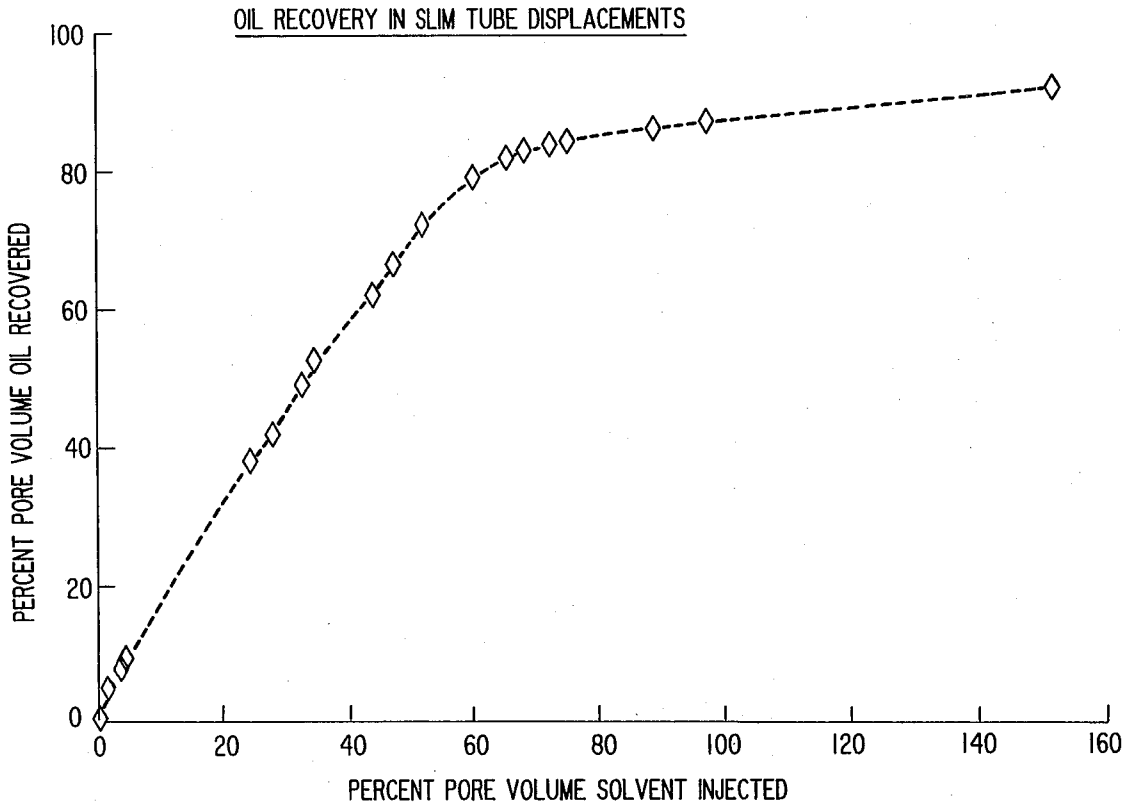
FIG. 3 shows the amount of the oil recovered, expressed as percent of pore volume of oil recovered, as a function of pore volume of $CO_2$ injected at 2250 psi. The $CO_2$ injection was preceded by the injection of a slug of a 20% pure volume of tall oil (Example 2).

The next experiment was conducted in the slim tube of Example 1 in the manner similar to that of Example 1 at a pressure of 2250 psi. A 20% pore volume slug of a tall oil, such as the distilled tall oil marketed by Arizona Chemical Company, Fair Lawn, N.J., under the brand name Acintol D30LR was first injected into the tube. The tall oil slug was followed by $CO_2$. Oil recovery was plotted as a function of the pore volume of $CO_2$ injected, plotted and shown in FIG. 3. Oil recovery and observation of effluent fluids indicated that miscible displacement occurred at 2250 psi. Displacement experiments were not conducted below the bubble point pressure of the oil (2200 psi) because no meaningful results can be obtained. The 2250 psi was considered the MMP of oil-$CO_2$ system with the tall oil additive. Therefore, the tall oil lowered the MMP of the $CO_2$-oil system to at most 2250 psi from 2650 psi without the additive.

The term "pore volume" as used herein, designates that volume of the portion of the formation underlying the well pattern employed in a given configuration as described in greater detail by Burdyn et al, U.S. Pat. No. 3,927,716, the entire disclosure of which is incorporated herein by reference.

It will be apparent to those skilled in the art that the specific embodiments discussed above can be successfully repeated with ingredients equivalent to those generically or specifically set forth above and under variable process conditions.

From the foregoing specification, one skilled in the art can readily ascertain the essential features of this invention and without departing from the spirit and scope thereof can adapt it to various diverse applications.

What is claimed is:

1. A miscible displacement process for recovering oil from a subterranean, oil-containing formation penetrated by at least one injection well and at least one spaced-apart production well and having fluid communication between the injection and the production wells, comprising the following steps:

(a) injecting a slug of tall oil into the formation through the injection well;

(b) injecting a slug of a displacing fluid into the formation through the injection well, the displacing fluid being selected from the group consisting of carbon monoxide, carbon dioxide, methane, nitrogen, air, flue gas, combustion gas and mixtures thereof, the injection of the tall oil lowering the minimum miscibility pressure of the displacing fluid in the formation oil; and (c) recovering the oil through the production well.

2. A process of claim 1 wherein the ratio of the displacing fluid slug to the slug of the tall oil is about 2:1 to about 10:1 by volume.

3. A process of claim 2 wherein the ratio of the displacing fluid slug to the slug of the tall oil is about 4:1 to about 6:1 by volume.

4. A process of claim 3 wherein the displacing fluid is selected from the group consisting of carbon monoxide and carbon dioxide.

5. A process of claim 4 wherein the displacing fluid is carbon dioxide.

6. A process of claim 5 wherein a drive fluid is is injected after step (b) but before step (c).

7. A process of claim 6 wherein the drive fluid is selected from the group consisting of water, brine, methane, carbon dioxide, nitrogen, air, steam, flue gas and mixtures thereof.

8. A process of claim 7 wherein the injection of the tall oil in step (a) lowers the minimum miscibility pressure of the reservoir oil-displacing fluid system at the temperature of the formation at which the displacing fluid miscibly displaces the oil.

9. A process of claim 8 wherein the injection of the tall oil in step (a) increases the viscosity of the displacing fluid.

10. A process of claim 9 wherein step (b) is conducted after step (a) is completed.

11. A process of claim 10 wherein the tall oil is soluble in the reservoir oil and in the displacing fluid at the reservoir temperature and pressure.

12. A miscible displacement process for recovering oil from a subterranean, oil-containing formation penetrated by at least one injection well and at least one spaced-apart production well and having fluid communication between the injection and the production wells, comprising the following steps:

(a) injecting a slug of tall oil into the formation through the injection well;

(b) simultaneously with step (a) injecting a slug of a displacing fluid into the formation, the displacing fluid being selected from the group consisting of carbon monoxide, carbon dioxide, methane, nitrogen, air, flue gas, combustion gas and mixtures thereof, the injection of the tall oil lowering the minimum miscibility pressure of the displacing fluid in the formation oil; and (c) recovering the oil through the production well.

13. A process of claim 12 wherein the ratio of the displacing fluid slug to the tall oil slug is about 1:20 to about 10:1.

14. A process of claim 13 wherein the displacing fluid is selected from the group consisting of carbon monoxide and carbon dioxide.

15. A process a claim 14 wherein the displacing fluid is carbon dioxide.

16. A process of claim 15 wherein a drive fluid is injected into formation after step (b) but before step (c).

17. A process of claim 16 wherein the drive fluid is selected from the group consisting of water, brine, methane, carbon dioxide, nitrogen, air, steam, flue gas and mixtures thereof.

18. A process of claim 17 wherein the injection of the tall oil lowers the minimum miscibility pressure of the reservoir oil-displacing fluid system at the temperature of the formation at which the displacing fluid miscibly displaces the oil.

19. A process of claim 18 wherein the injection of the tall oil increases the viscosity of the displacing fluid.

20. A process of claim 19 wherein the tall oil is soluble in the reservoir oil and in the displacing fluid at the reservoir temperature and pressure.

* * * * *

UNITED STATES PATENT AND TRADEMARK OFFICE

CERTIFICATE OF CORRECTION

PATENT NO. : 4,736,793

DATED : April 12, 1988

INVENTOR(S) : Nizar F. Djabbarah

It is certified that error appears in the above-identified patent and that said Letters Patent is hereby corrected as shown below:

Col. 3, line 22, "transistion" should be --transition--.

Col. 3, line 65, "alchols" should be --alcohols--.

Col. 4, line 40, "along" should be --alone--.

Col. 5, line 29, after "a", "the" should be deleted.

Signed and Sealed this

Twenty-fourth Day of January, 1989

*Attest:*

*Attesting Officer*

DONALD J. QUIGG

*Commissioner of Patents and Trademarks*